US009599934B2

(12) United States Patent
Hozumi et al.

(10) Patent No.: US 9,599,934 B2
(45) Date of Patent: Mar. 21, 2017

(54) IMAGE FORMING APPARATUS HAVING AN ANGLE ADJUSTER FOR A TILTABLE SUPPORT ROLLER

(71) Applicants: Yoshiki Hozumi, Kanagawa (JP); Naomi Sugimoto, Kanagawa (JP); Kazuchika Saeki, Kanagawa (JP); Yasufumi Takahashi, Kanagawa (JP); Naoki Iwaya, Tokyo (JP); Masaharu Furuya, Kanagawa (JP)

(72) Inventors: Yoshiki Hozumi, Kanagawa (JP); Naomi Sugimoto, Kanagawa (JP); Kazuchika Saeki, Kanagawa (JP); Yasufumi Takahashi, Kanagawa (JP); Naoki Iwaya, Tokyo (JP); Masaharu Furuya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/796,353

(22) Filed: Jul. 10, 2015

(65) Prior Publication Data

US 2016/0062279 A1 Mar. 3, 2016

(30) Foreign Application Priority Data

Aug. 29, 2014 (JP) ..... 2014-176283

(51) Int. Cl.
*G03G 15/16* (2006.01)

(52) U.S. Cl.
CPC ..... *G03G 15/1605* (2013.01); *G03G 15/167* (2013.01); *G03G 2215/0129* (2013.01)

(58) Field of Classification Search
CPC ..... G03G 15/167
(Continued)

(56) References Cited

U.S. PATENT DOCUMENTS

2009/0062048 A1* 3/2009 Nakura ..... G03G 15/1615 474/135
2009/0279918 A1* 11/2009 Sendo ..... G03G 15/167 399/121

(Continued)

FOREIGN PATENT DOCUMENTS

JP 3-279137 12/1991
JP 3-288743 12/1991

(Continued)

OTHER PUBLICATIONS

U.S. Appl. No. 14/690,857, filed Apr. 20, 2015, Yoshiki Hozumi, et al.
U.S. Appl. No. 14/605,459, filed Jan. 26, 2015.

*Primary Examiner* — Walter L Lindsay, Jr.
*Assistant Examiner* — Arlene Heredia Ocasio
(74) *Attorney, Agent, or Firm* — Oblon, McClelland, Maier & Neustadt, L.L.P.

(57) ABSTRACT

An image forming apparatus includes a toner image forming device to form a toner image on a rotatable toner image bearer, a looped belt to carry a recording medium, a support roller to rotate the belt, a pressing member to press the belt against the toner image bearer, a transfer electric field generator to form an electric field to transfer the toner image onto the recording medium, and a contact member to contact an end surface of the belt as the belt moves to one side in a belt width direction. The belt includes a first portion pressed against the toner image bearer by the pressing member and a second portion adjoining the first portion. A relative position of the support roller relative to the toner image bearer and the pressing member is determined such that the second portion of the belt contacts the toner image bearer.

6 Claims, 8 Drawing Sheets

AFTER ADJUSTMENT

(58) Field of Classification Search
USPC ..... 399/313
See application file for complete search history.

(56) References Cited

U.S. PATENT DOCUMENTS

| | | | | |
|---|---|---|---|---|
| 2011/0013950 | A1* | 1/2011 | Furuya | G03G 15/167 399/302 |
| 2012/0141166 | A1* | 6/2012 | Kakehi | G03G 15/167 399/121 |
| 2013/0192959 | A1* | 8/2013 | Kitamura | B65H 5/021 198/806 |
| 2013/0206549 | A1* | 8/2013 | Clevers | G03G 15/167 198/807 |
| 2013/0306440 | A1 | 11/2013 | Asaoka et al. | |
| 2013/0306441 | A1 | 11/2013 | Asaoka et al. | |
| 2014/0023387 | A1* | 1/2014 | Goto | G03G 15/1615 399/66 |
| 2014/0083821 | A1* | 3/2014 | Hozumi | G03G 15/1615 198/806 |
| 2014/0183007 | A1* | 7/2014 | Hozumi | G03G 15/1615 198/806 |
| 2014/0209437 | A1* | 7/2014 | Hozumi | B41J 11/007 198/806 |
| 2015/0090564 | A1 | 4/2015 | Iwaya et al. | |
| 2015/0117914 | A1 | 4/2015 | Hozumi et al. | |
| 2015/0125189 | A1 | 5/2015 | Hozumi et al. | |

FOREIGN PATENT DOCUMENTS

| | | |
|---|---|---|
| JP | 4-133929 | 5/1992 |
| JP | 2006-267243 | 10/2006 |
| JP | 2010-230958 | 10/2010 |
| JP | 2012-103286 | 5/2012 |

* cited by examiner

IMMEDIATELY AFTER ASSEMBLY

AFTER ADJUSTMENT

BEFORE ADJUSTMENT

AFTER ADJUSTMENT

IMAGE FORMING APPARATUS HAVING AN ANGLE ADJUSTER FOR A TILTABLE SUPPORT ROLLER

CROSS-REFERENCE TO RELATED APPLICATIONS

This patent application is based on and claims priority pursuant to 35 U.S.C. §119 to Japanese Patent Application No. 2014-176283, filed on Aug. 29, 2014, in the Japan Patent Office, the entire disclosure of which is hereby incorporated by reference herein.

BACKGROUND

Technical Field

Exemplary aspects of the present invention generally relate to a belt assembly including an endless looped belt entrained about a plurality of rollers, and an image forming apparatus, such as a copier, a facsimile machine, or a printer including the belt assembly.

Description of the Related Art

There has been known a color image forming apparatus using an electrophotographic method in which toner images of different colors formed on latent image bearers are primarily transferred onto an intermediate transfer body in a primary transfer process and then onto a recording medium in a secondary transfer process. A secondary transfer device employed in the image forming apparatus of this type is equipped with a belt (i.e., a secondary transfer belt) formed into an endless loop and looped around a plurality of support rollers. A recording medium is interposed between the intermediate transfer body and the secondary transfer belt, thereby transferring the toner image onto the recording medium in the secondary transfer process. This is known as a belt transfer method.

In the belt transfer method, the secondary transfer belt is pressed against the intermediate transfer body by the support roller opposite to the intermediate transfer body to form a secondary transfer nip. In the secondary transfer nip, a secondary transfer voltage is applied to the intermediate transfer body, while the support roller that presses the secondary transfer belt against the intermediate transfer body is electrically grounded, thereby forming a transfer electric field. With the transfer electric field, the toner image on the intermediate transfer body is transferred onto the recording medium delivered to the secondary transfer nip.

Generally, in the belt transfer method, the secondary transfer belt may drift to one side in a width direction of the secondary transfer belt or repeatedly wander back and forth on either side in the width direction of the belt. Such misalignment of the belt (including belt wander) is attributed to dimensional tolerance of parts constituting the secondary transfer device, for example, variations in a parallelism error of rotary shafts of the plurality of support rollers that supports the secondary transfer belt, variations in an outer diameter of the rollers, and variations in the tension of the secondary transfer belt due to changes in the circumferential length of the secondary transfer belt itself.

In order to minimize misalignment of the belt within a certain range, in one example, a flange as a belt tracking member is disposed on both ends of the support roller in an axial direction thereof around which the secondary transfer belt is looped, thereby controlling movement of the belt. In this configuration, as the secondary transfer belt drifts off center in the width direction and reaches the end of the support roller in the axial direction thereof, the end portion of the secondary transfer belt contacts the flange, preventing the secondary transfer belt from moving any further to the side.

However, there is a drawback in this configuration using the flange as the belt tracking member disposed on both ends of the support roller in that the secondary transfer belt creases, hence causing image defects.

SUMMARY

In view of the foregoing, in an aspect of this disclosure, there is provided an improved image forming apparatus including a toner image bearer, a toner image forming device, a belt, a support roller, a pressing member, a transfer electric field generator, and a contact member. The toner image bearer carries a toner image and is rotatable. The toner image forming device forms a toner image on the toner image bearer. The belt is formed into an endless loop to carry a recording medium and to travel in a certain direction. The support roller rotates the belt. The pressing member presses the belt against the toner image bearer. The transfer electric field generator forms an electric field to transfer the toner image from the toner image bearer onto the recording medium. The contact member contacts an end surface of the belt as the belt moves to one side in a belt width direction. The belt includes a first portion pressed against the toner image bearer by the pressing member and a second portion adjoining the first portion. A relative position of the support roller relative to the toner image bearer and the pressing member is determined such that the second portion of the belt contacts the toner image bearer.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
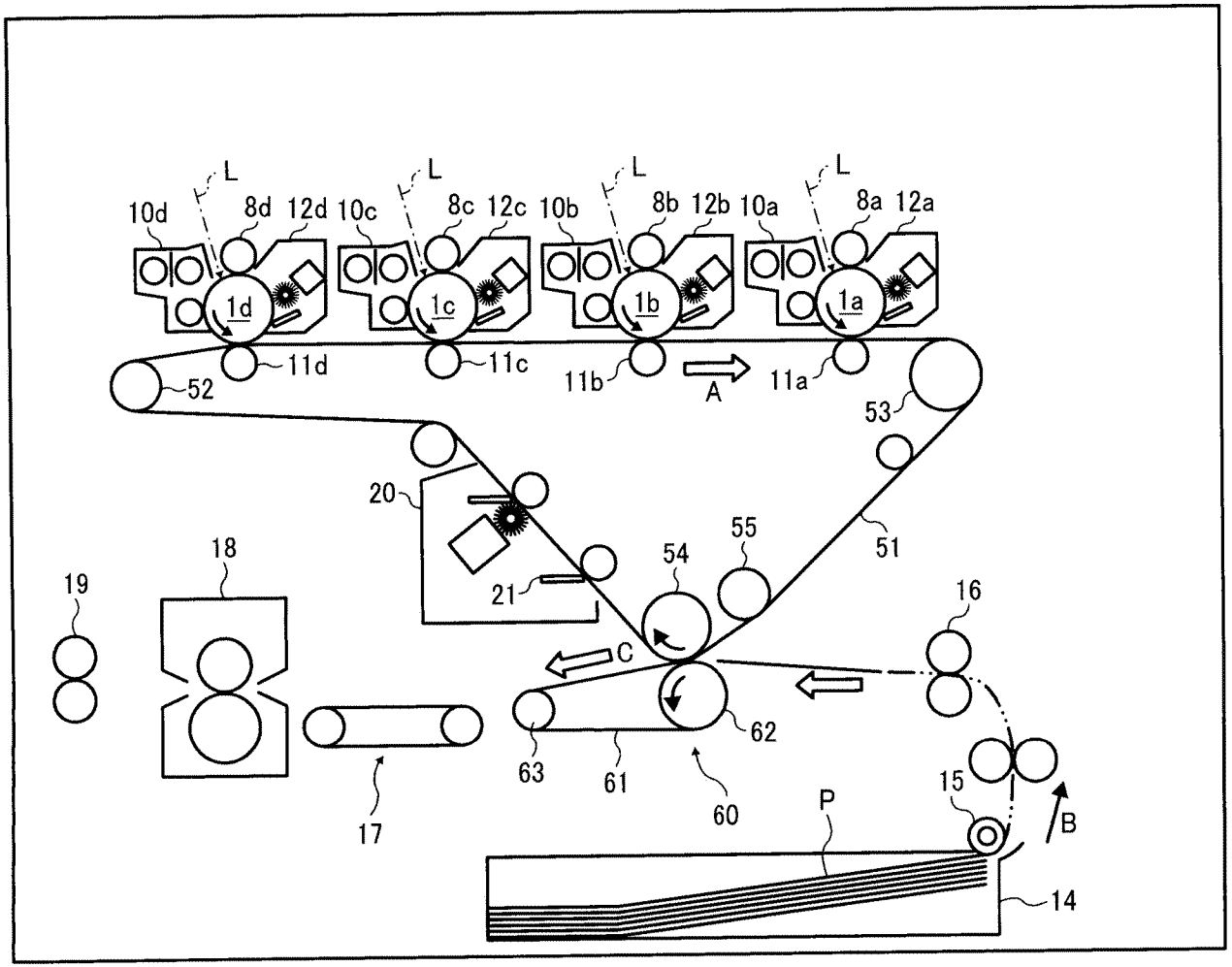
FIG. 1 is a schematic diagram illustrating a printer as an example of an image forming apparatus, according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

FIG. 1 is a schematic diagram illustrating a printer as an example of an image forming apparatus of the present disclosure.

As illustrated in FIG. 1, the image forming apparatus includes four photoconductors 1*a*, 1*b*, 1*c*, and 1*d* disposed inside a main body housing of the image forming apparatus. Toner images of different colors are formed on the respective photoconductors 1*a*, 1*b*, 1*c*, and 1*d*. More specifically, a black toner image, a magenta toner image, a cyan toner image, and a yellow toner image are formed on the photoconductors 1*a*, 1*b*, 1*c*, and 1*d*, respectively. According to the present illustrative embodiment, the photoconductors 1*a*, 1*b*, 1*c*, and 1*d* have a drum shape. Alternatively, the photoconductors 1*a*, 1*b*, 1*c*, and 1*d* may employ an endless looped belt entrained about a plurality of rollers and driven to rotate.

The image forming apparatus includes an intermediate transfer belt 51 formed into an endless loop as an intermediate transfer member which serves as an image bearer. The intermediate transfer belt 51 faces the four photoconductors 1*a*, 1*b*, 1*c*, and 1*d*. The outer circumferential surface of each of the photoconductors 1*a*, 1*b*, 1*c*, and 1*d* contacts the outer circumferential surface of the intermediate transfer belt 51. The intermediate transfer belt 51 is entrained about and stretched taut between a plurality of support rollers: a tension roller 52, a drive roller 53, a repulsive roller 54 serving as a part of a transfer electric field generator, an entry roller 55, and so forth. The drive roller 53, which is one of support rollers, is driven to rotate by a drive source, and rotation of the drive roller 53 enables the intermediate transfer belt 51 to travel in a direction of hollow arrow A in FIG. 1.

The intermediate transfer belt 51 may be a single-layer belt or a multi-layer belt. In the case of the multi-layer belt, a base layer of the belt may be formed of a relatively inelastic fluorine resin such as a polyvinylidene fluoride (PVDF) sheet and polyimide resin, with a smooth coating layer of fluorine resin deposited on the outer surface of the belt. In the case of a single-layer belt, the belt material may be selected from, for example, polyvinylidene difluoride (PVDF), polycarbonate (PC), and polyimide (PI).

The configuration and operation for forming toner images on each of the photoconductors 1*a*, 1*b*, 1*c*, and 1*d*, all have a similar or the same configuration as all the others, differing only in the color of toner employed. Similarly, the configuration and operation for transferring primarily the toner images onto the intermediate transfer belt 51 have a similar or the same configuration as all the others, differing only the color of toner employed. Thus, a description is provided only of the photoconductor 1*a* for forming a black toner image and its associated imaging equipment as a representative example of the photoconductors and associated imaging equipment. The description of the photoconductors 1*b*, 1*c*, and 1*d*, and associated imaging equipment are omitted herein, unless otherwise indicated.

The photoconductor 1*a* rotates in the counterclockwise direction indicated by arrow in FIG. 1. The outer circumferential surface of the photoconductor 1*a* is irradiated with light from a static eliminating device, thereby initializing the surface potential of the photoconductor 1*a*. The initialized outer circumferential surface of the photoconductor 1*a* is charged uniformly by a charging device 8*a* to a predetermined polarity (in the present illustrative embodiment, a negative polarity). Similarly, the initialized outer circumferential surfaces of the photoconductors 1*b*, 1*c*, and 1*d* are charged uniformly by charging devices 8*b*, 8*c*, and 8*d*. Subsequently, an exposure device irradiates the charged outer circumferential surface of the photoconductor 1*a* with a modulated laser beam L, thereby forming an electrostatic latent image on the surface of the photoconductor 1*a*.

According to the present illustrative embodiment, the exposure device that projects the laser beam L includes a laser writing device. Alternatively, the exposure device may include an LED array and an imaging device. The electrostatic latent image formed on the photoconductor 1*a* is developed with a respective color of toner, i.e., black, by a developing device 10*a* into a visible image, known as a black toner image. Reference numerals 10*b*, 10*c*, and 10*d* also refer to developing devices.

Primary transfer rollers 11*a*, 11*b*, 11*c*, and 11*d* serving as primary transfer devices are disposed inside the looped intermediate transfer belt 51, facing the photoconductors 1*a*, 1*b*, 1*c*, and 1*d*, respectively. The primary transfer roller 11*a*, hereinafter described as a representative example of the primary transfer rollers, contacts the inner circumferential surface of the intermediate transfer belt 51 to form a primary transfer nip between the photoconductor 1*a* and the intermediate transfer belt 51. The primary transfer roller 11*a* is supplied with a primary transfer voltage having a polarity (in the present illustrative embodiment, a positive polarity) opposite a charge polarity of the toner image formed on the photoconductor 1*a*, thereby forming a primary transfer electric field between the photoconductor 1*a* and the intermediate transfer belt 51 and transferring electrostatically the toner image onto the intermediate transfer belt 51.

After the toner image is primarily transferred onto the intermediate transfer belt 51, residual toner remaining on the surface of the photoconductor 1*a* is removed by a cleaning device 12*a*. Similarly, the photoconductors 1*b*, 1*c*, and 1*d* are cleaned by cleaning devices 12*b*, 12*c*, and 12*d*, respectively.

In a full color mode in which toner images of four different colors are formed, similar to the black toner image, a magenta toner image, a cyan toner image, and an yellow toner image are formed on the photoconductors 1*b*, 1*c*, and 1*d*, respectively. As described above, the toner images in the colors magenta, cyan, and yellow are transferred onto the intermediate transfer belt 51, such that they are superimposed one atop the other on the black toner image which has been primarily transferred onto the intermediate transfer belt 51.

When forming a single color image of black color, such as in a monochrome mode, the primary transfer rollers 11*b*, 11*c*, and 11*d*, other than the primary transfer roller 11*a* for black, are separated from the photoconductors 1*b*, 1*c*, and 1*d* for the colors magenta, cyan, and yellow by a moving device. In a state in which only the photoconductor 1*a* is in contact with the intermediate transfer belt 51, only the black toner image is transferred primarily onto the intermediate transfer belt 51. The above-described devices, for example, the photoconductors 1*a*, 1*b*, 1*c*, and 1*d*, the charging devices 8*a*, 8*b*, 8*c*, and 8*d*, the developing devices 10*a*, 10*b*, 10*c*, and 10*d*, the primary transfer rollers 11*a*, 11*b*, 11*c*, and 11*d*, and so force constitute a toner image forming device.

As illustrated in FIG. 1, a paper feed device 14 is disposed substantially at the bottom of the main body of the image forming apparatus. The paper feed device 14 includes a feed roller 15 to pick up and send a recording medium P as transfer paper in a direction indicated by an arrow B in FIG. 1. The recording medium P fed by the feed roller 15 is delivered in a predetermined timing to a secondary transfer nip at which the intermediate transfer belt 51 looped around the repulsive roller 54 contacts a secondary transfer belt 61 of a secondary transfer device 60. The recording medium P is sent to the secondary transfer nip in appropriate timing by a pair of registration rollers 16. At this time, a secondary-transfer power source as a transfer voltage output device supplies a predetermined secondary transfer voltage to the repulsive roller 54 to transfer secondarily the toner image from the intermediate transfer belt 51 onto the recording medium P.

In the secondary transfer device 60, the secondary transfer belt 61 is entrained about and stretched taut between a secondary transfer roller 62 and a separation roller 63. Rotation of one of the secondary transfer roller 62 and the separation roller 63 (support rollers) enables the secondary transfer belt 61 to travel in a direction indicated by a hollow arrow C in FIG. 1. The recording medium P, onto which the toner image is secondarily transferred, is carried on the outer circumferential surface of the secondary transfer belt 61 and transported while the recording medium P is attracted electrostatically to the outer circumferential surface of the secondary transfer belt 61.

Subsequently, the recording medium P separates from the surface of the secondary transfer belt 61 at the curved portion of the secondary transfer belt 61 entrained about the separation roller 63, and is transported further downstream from the secondary transfer belt 61 in a transport direction of the recording medium P by a conveyor belt 17 disposed downstream from the secondary transfer belt 61. When the recording medium P passes through a fixing device 18 which applies heat and pressure to the toner image on the recording medium P, the toner image is fixed to the recording medium P. After the recording medium P passes through the fixing device 18, the recording medium P is discharged outside the main body through a pair of output rollers 19 of a discharge unit.

Residual toner remaining on the intermediate transfer belt 51 after the toner image is secondarily transferred therefrom is removed by a belt cleaning device 20. In the present illustrative embodiment, the belt cleaning device 20 includes a cleaning blade 21 made of suitable material, such as urethane, held against the intermediate transfer belt 51 to mechanically remove or scrape toner residues from the belt surface. Alternatively, instead of or in combination with a cleaning blade, any suitable cleaning device may be used to clean the intermediate transfer belt 51, including, for example, an electrostatic cleaning device for electrostatically removing toner residues from the belt surface.

In order to facilitate an understanding of the novel features of the present disclosure, as a comparison, a description is provided of a comparative example of an image forming apparatus.

Figure 12:
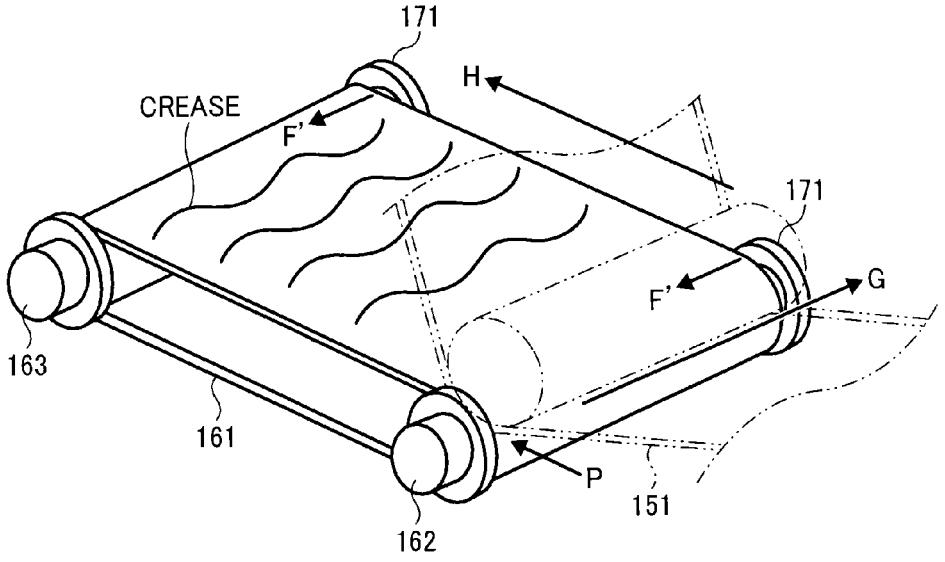
FIG. 12 is a conceptual diagram illustrating an example of creasing of the secondary transfer belt when the secondary transfer belt comes in contact with a belt tracking member.

FIG. 12 is a schematic diagram illustrating a comparative example of a configuration around the secondary transfer nip. As illustrated in FIG. 12, a secondary transfer belt 161 is looped around support rollers 162 and 163, and travels endlessly in a direction of arrow H. In this configuration, the secondary transfer belt 161 is pressed against an intermediate transfer body 151 by the support roller 162 facing the intermediate transfer body 151 to form a secondary transfer nip. A recording medium P is fed to the secondary transfer nip in a direction of arrow.

As the secondary transfer belt 161 runs toward one side in the belt width direction indicated by arrow G and comes in contact with a flange 171, the secondary transfer belt 161 receives a reaction force (indicated by arrow F') from the flange 171. When receiving the force acting in the opposite direction to the traveling direction of the secondary transfer belt 161, the secondary transfer belt 161 creases. The secondary transfer belt creases not only in the configuration with the belt tracking member such as the flange as described above, but also in a configuration in which there is a part that contacts the secondary transfer belt and applies a reaction force thereto when the secondary transfer belt drifts off center in the width direction.

The secondary transfer belt creases near the secondary transfer nip as well. When the secondary transfer belt creases near the secondary transfer nip, a small gap is formed partially between the outer circumferential surface of the secondary transfer belt and the recording medium. When forming an electric field in the secondary transfer nip, an electrical discharge occurs in a small space near the secondary transfer nip due to dielectric breakdown, causing image defects such as toner scattering and blank spots in an image on the recording medium P.

In view of the above, there is demand for an image forming apparatus that is capable of preventing image defects caused by creasing of a belt that carries a recording medium.

Next, a description is provided of a belt alignment device employed in the secondary transfer device 60 equipped with the secondary transfer belt 61.

According to the present illustrative embodiment, the belt alignment device employed in the secondary transfer device 60 includes a shaft moving device 70 to tilt a rotary shaft 63*a* of the separation roller 63 about which the secondary transfer belt 61 is entrained so as to adjust misalignment of the secondary transfer belt 61 within a predetermined permissible range. The separation roller 63 is one of support rollers around which the secondary transfer belt 61 is looped.

Figure 2:
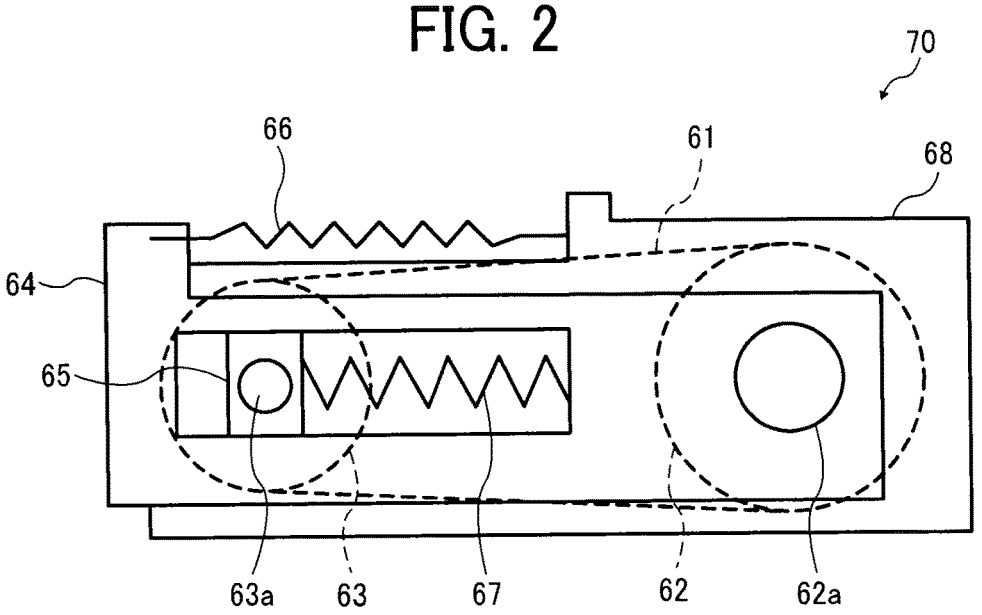
FIG. 2 is a schematic diagram illustrating a shaft moving device of a secondary transfer device employed in the image forming apparatus of FIG. 1 immediately after assembly as viewed in an axial direction of a separation roller.

FIG. 2 is a schematic diagram illustrating the shaft moving device 70 immediately after assembly, as viewed in an axial direction of the separation roller 63.

Figure 3:
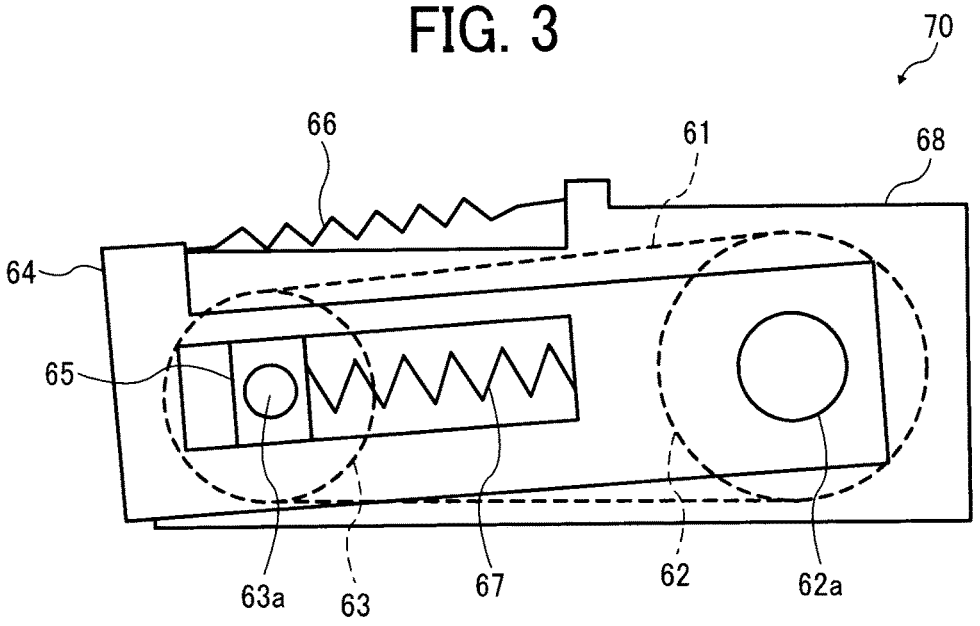
FIG. 3 is a schematic diagram illustrating the shaft moving device after adjustment of misalignment of a belt as viewed in the axial direction of the separation roller.

FIG. 3 is a schematic diagram illustrating the shaft moving device 70 after adjustment of misalignment of the secondary transfer belt 61, as viewed in the axial direction of the separation roller 63.

Each end of the rotary shaft 63*a* of the separation roller 63 is supported individually by different support arms 64. Each shaft support arm 64 is rotatably attached to each end of the rotary shaft 62*a* of the secondary transfer roller 62 and is biased in a clockwise direction in FIG. 2 by an arm spring 66 with one end thereof fixed to a frame 68 of the secondary transfer device 60. In a state in which there is no misalignment of the secondary transfer belt 61 immediately after assembly, a rotation position of the shaft support arms 64 is maintained at a position at which the shaft support arms 64 contact the frames 68 due to a bias force of the arm spring 66 as illustrated in FIG. 2.

As illustrated in FIGS. 2 and 3, each shaft support arm 64 slidably supports a shaft bearing 65 that bears the rotary shaft 63*a* of the separation roller 63 such that the shaft bearing 65 is slidable in a radial direction from the center of rotation of the support arm 64. The shaft bearing 65 is biased outward by a tension spring 67 in the radial direction from the center of rotation of the support arms 64. With this configuration, the separation roller 63 is always biased in such a direction that the separation roller 63 separates from the secondary transfer roller 62. Accordingly, a certain tension is applied to the secondary transfer belt 61 looped around the separation roller 63 and the secondary transfer roller 62.

Figure 4:
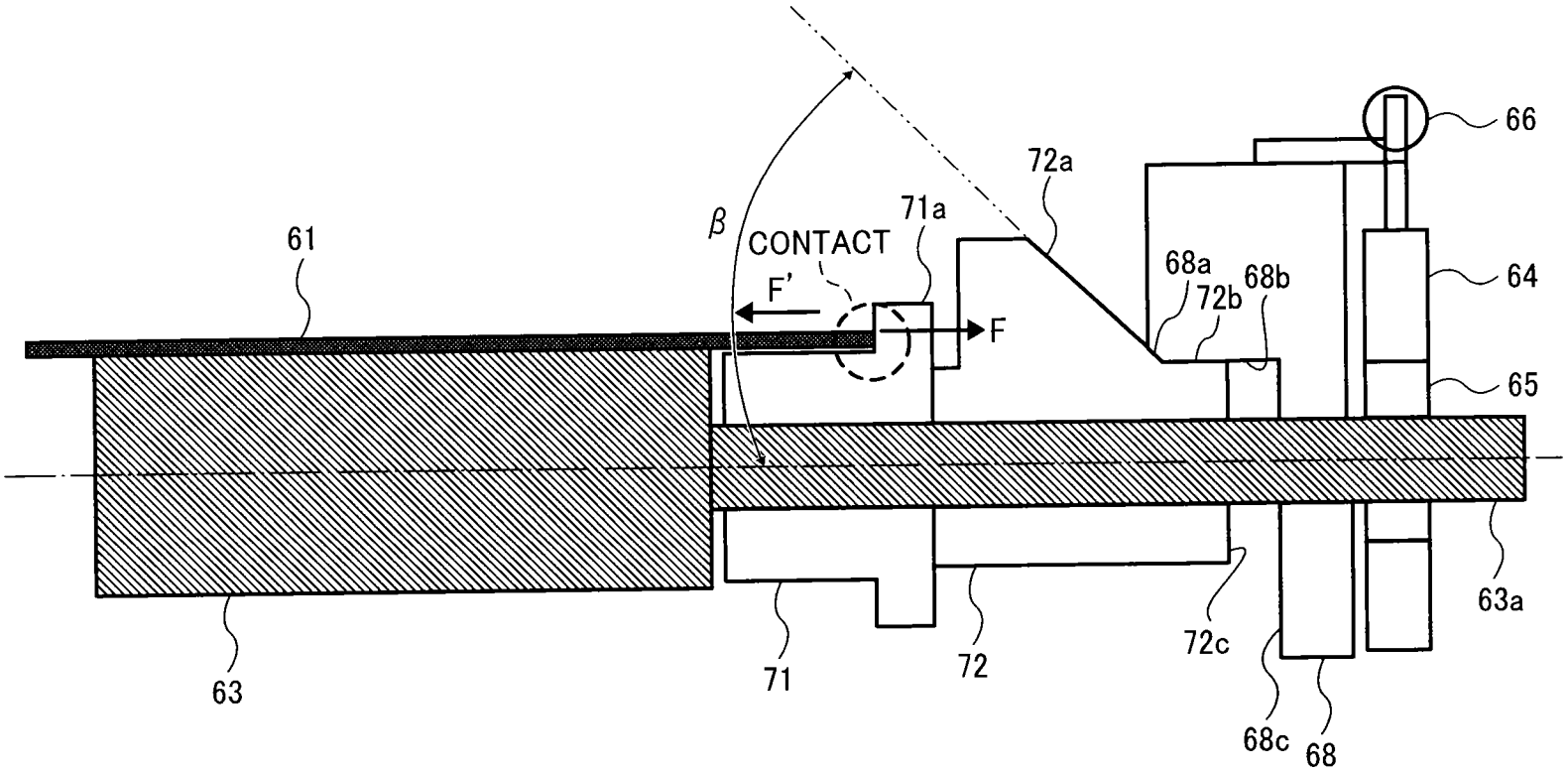
FIG. 4 is a cross-sectional diagram schematically illustrating the shaft moving device immediately after assembly, taken along a rotary shaft of the separation roller.

FIG. 4 is a cross-sectional diagram schematically illustrating the shaft moving device 70 of the secondary transfer device 60, cut along the rotary shaft 63*a* of the separation roller 63.

A belt deviation detector 71 and a shaft inclining member 72 as an angle adjuster are disposed on the rotary shaft 63*a* between the separation roller 63 and the shaft bearing 65. The belt deviation detector 71 and the shaft inclining member 72 constitute an axial-direction displacement device. The belt deviation detector 71 includes a flange 71*a* that contacts an end portion of the secondary transfer belt 61. As the secondary transfer belt 61 moves in the direction of the belt width and the end portion of the secondary transfer belt 61 contacts the flange 71*a*, exerting a force on the belt deviation detector 71 in the direction of arrow F, the belt deviation detector 71 moves outward in the axial direction along the rotary shaft 63*a* of the separation roller 63. As the belt deviation detector 71 moves outward in the axial direction along the rotary shaft 63*a*, the shaft inclining member 72 which is disposed outside the belt deviation detector 71 on the rotary shaft 63*a* moves outward in the axial direction along the rotary shaft 63*a*.

In the meantime, the secondary transfer belt 61 receives a reaction force in a direction of arrow F' from the flange 71*a*, and as a result, the secondary transfer belt 61 between the separation roller 63 and the secondary transfer roller 62 (i.e., a portion of the secondary transfer belt 61 that is not in contact with the separation roller 63 and the secondary transfer roller 62) creases.

A contact portion 68*a* of the frame 68 serving as a fixation member contacts a slanted surface 72*a* of the shaft inclining member 72 from outside the rotary shaft 63*a* in the axial direction. The end portion of the rotary shaft 63*a* of the separation roller 63 on which the shaft inclining member 72 is disposed is supported, via the shaft bearing 65, by the shaft support arm 64 which is biased by the arm spring 66. Thus, the end portion of the rotary shaft 63*a* of the separation roller 63 is biased upward in FIG. 4. Accordingly, in a state in which the end portion of the secondary transfer belt 61 is not in contact with the flange 71*a* of the belt deviation detector 71, the spring force of the arm spring 66 adjusts the contact position at which the contact portion 68*a* of the frame 68 and the slanted surface 72*a* of the shaft inclining member 72 contact to a position at which a first stopper surface 68*b* of the frame 68 contacts a contact surface 72*b* of the shaft inclining member 72. The contact surface 72*b* of the shaft inclining member 72 is continuously formed at the lower end of the slanted surface 72*a*. That is, the contact portion 68*a* of the frame 68 is held in a state in which the contact portion 68*a* contacts the lower end portion of the slanted surface 72*a* of the shaft inclining member 72.

Figure 5:
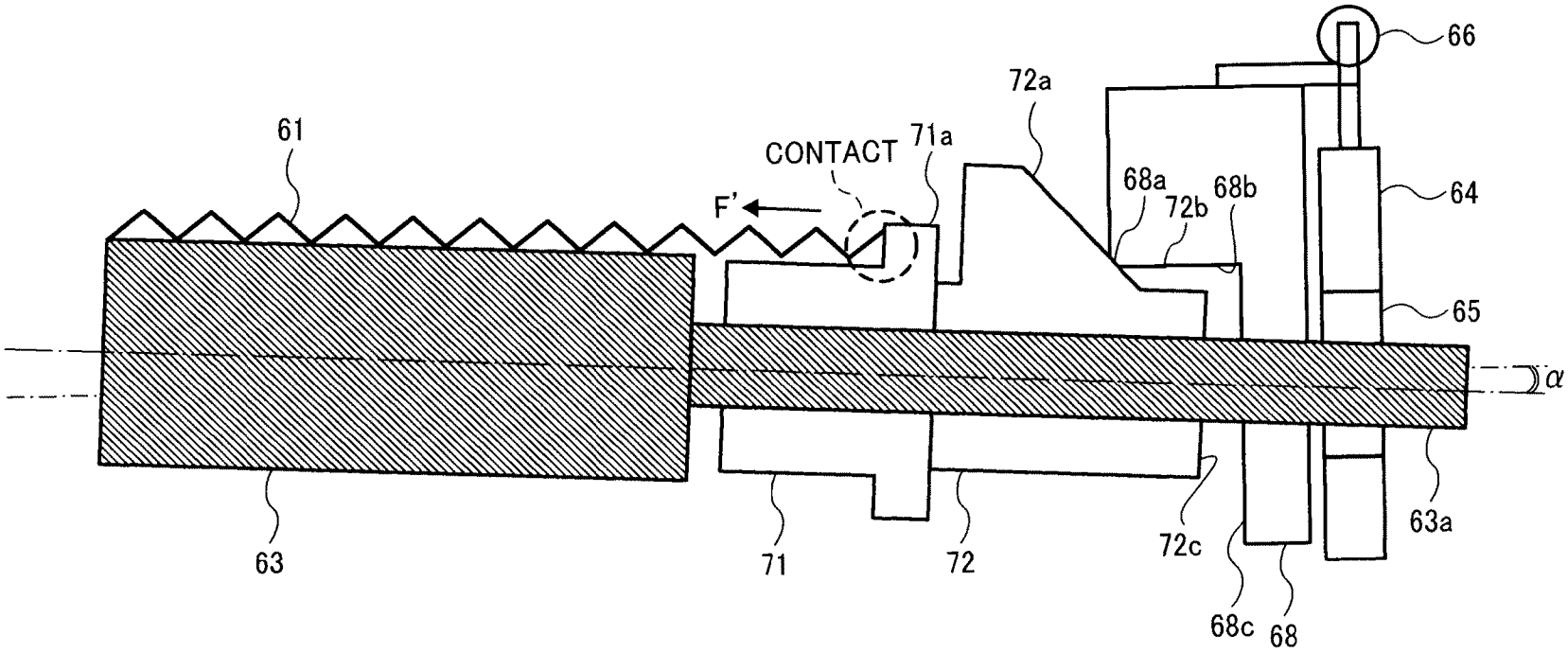
FIG. 5 is a cross-sectional diagram schematically illustrating the shaft moving device after adjustment of the misalignment of the belt, taken along the rotary shaft of the separation roller.

In this state, the secondary transfer belt 61 receives a force causing the secondary transfer belt 61 to move in the direction of the belt width, thereby moving the belt deviation detector 71 and the shaft inclining member 72 outward in the axial direction along the rotary shaft 63*a*. As a result, the contact portion 68*a* of the frame 68 relatively moves along the slanted surface 72*a* of the shaft inclining member 72. The contact position at which the slanted surface 72*a* of the shaft inclining member 72 contacts the contact portion 68*a* of the frame 68 moves up towards the upper portion of the slanted surface 72*a*. As a result, the axial end portion of the rotary shaft 63*a* of the separation roller 63 in the moving direction of the secondary transfer belt 61 is pressed down against the biasing force of the arm spring 66 as illustrated in FIG. 5.

At this time, the end portion of the secondary transfer belt 61 is not in contact with the flange 71*a* of the belt deviation detector 71. Accordingly, as illustrated in FIG. 4, the contact portion 68*a* of the frame 68 is held in a state in which the contact portion 68*a* of the frame 68 contacts the lower end portion of the slanted surface 72*a* of the shaft inclining member 72. The opposite end of the rotary shaft 63*a* of the separation roller 63, which is the opposite end in the moving direction of the secondary transfer belt 61, is pressed down relative to the other end, causing the rotary shaft 63*a* to tilt.

As the rotary shaft 63*a* of the separation roller 63 tilts further, the moving speed of the secondary transfer belt 61 in the direction of the belt width slows down gradually, and ultimately the secondary transfer belt 61 moves in the direction opposite to the direction of the belt width. As a result, the position of the secondary transfer belt 61 in the width direction returns gradually, thereby running the secondary transfer belt 61 on track and enabling the secondary transfer belt 61 to travel reliably. The same is true for the case in which the direction of misalignment of the secondary transfer belt 61 is in the direction opposite to the direction described above.

Figure 6:
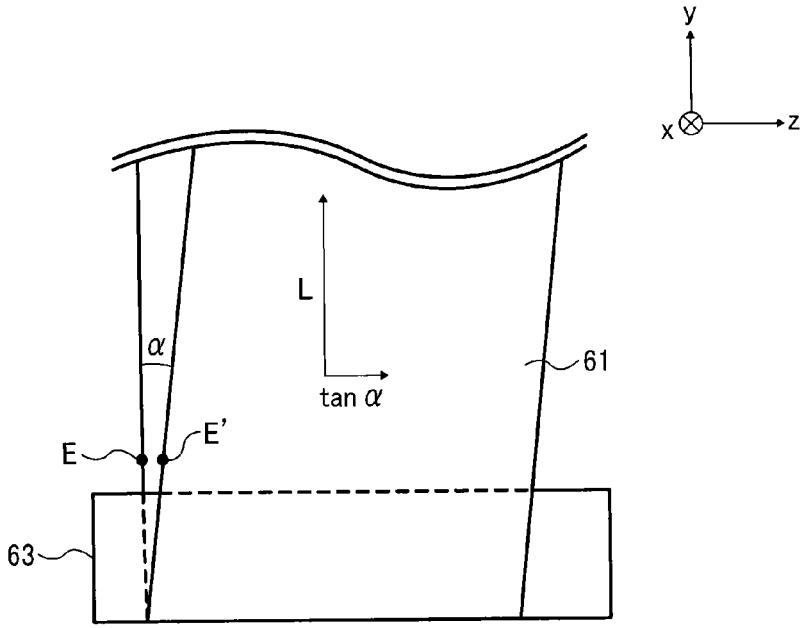
FIG. 6 is a conceptual diagram illustrating an example of misalignment of a secondary transfer belt of the secondary transfer device.

With reference to FIG. 6, a description is provided of a principle of correction of belt misalignment by tilting the rotary shaft 63*a* of the separation roller 63.

FIG. 6 is a conceptual diagram illustrating misalignment of the secondary transfer belt 61.

Here, it is assumed that the secondary transfer belt 61 has a rigid body, and an arbitrary point (i.e., a point E on the belt end portion) on the secondary transfer belt 61 before advancing to the separation roller 63 is observed. As long as the secondary transfer belt 61 entrained about and stretched taut between two rollers, i.e., the secondary transfer roller 62 and the separation roller 63, is completely horizontal or parallel, the position of the secondary transfer belt 61 in the axial direction of the separation roller 63 does not change between the point E on the secondary transfer belt 61 immediately before advancing to the separation roller 63 and a point E' corresponding to the point E immediately after exiting the separation roller 63. In this case, the secondary transfer belt 61 does not travel out of alignment.

By contrast, in a case in which the rotary shaft 63*a* of the separation roller 63 is inclined at an inclination angle $\alpha$ relative to the rotary shaft 62*a* of the secondary transfer roller 62, the point E on the secondary transfer belt 61 shifts by an amount of tan a in the axial direction of the separation roller 63 while moving along the peripheral surface of the separation roller 63 as illustrated in FIG. 6. Therefore, by tilting the rotary shaft 63*a* of the separation roller 63 at the inclination angle $\alpha$ relative to the rotary shaft 62*a* of the secondary transfer roller 62, the position of the secondary transfer belt 61 in the width direction of the belt can be moved approximately by the amount of tan a in accordance with the rotation of the separation roller 63.

The amount of belt misalignment (moving speed in the width direction of the belt) of the secondary transfer belt 61 is proportional to the inclination angle $\alpha$. That is, the greater is the inclination angle $\alpha$, the greater is the amount of displacement of the secondary transfer belt 61. The smaller is the inclination angle $\alpha$, the smaller is the amount of displacement of the secondary transfer belt 61. For example, in a case in which the secondary transfer belt 61 wanders to the right side as illustrated in FIG. 5, this belt displacement causes the shaft inclining member 72 to move in the axial direction of the separation roller 63, thereby moving the rotary shaft 63*a* of the separation roller 63 down in FIG. 5 and thus bringing the secondary transfer belt 61 back to the left in FIG. 5. With this configuration, the rotary shaft 63*a* of the separation roller 63 is inclined, hence moving the secondary transfer belt 61 in the opposite direction to the direction of the initial belt misalignment and thus compensating the initial belt misalignment of the secondary transfer belt 61. In other words, the secondary transfer belt 61 is moved to a place at which the initial belt misalignment and the displacement of the secondary transfer belt 61 caused by the inclination of the rotary shaft 63*a* are balanced, thereby correcting the misalignment of the secondary transfer belt 61.

In the event in which the secondary transfer belt 61 traveling at the balanced position starts to wander toward either side, the inclination of the rotary shaft 63*a* of the separation roller 63 in accordance with the displacement of the secondary transfer belt 61 brings the secondary transfer belt 61 to the balanced position again.

According to the present illustrative embodiment, the shaft moving device 70 of the secondary transfer device 60 tilts the rotary shaft 63*a* of the separation roller 63 at an inclination angle corresponding to the amount of displacement of the secondary transfer belt 61 in the direction of the belt width. Accordingly, misalignment of the secondary transfer belt 61 is corrected fast. Furthermore, in order to tilt the rotary shaft 63*a* of the separation roller 63, the moving force of the secondary transfer belt 61 moving in the direction of the belt width is used so that an additional drive source such as a motor is not necessary, and hence no extra space is needed to accommodate the drive source. The rotary shaft 63*a* of the separation roller 63 can be tilted with a simple configuration without a dedicated drive source.

Figure 7:
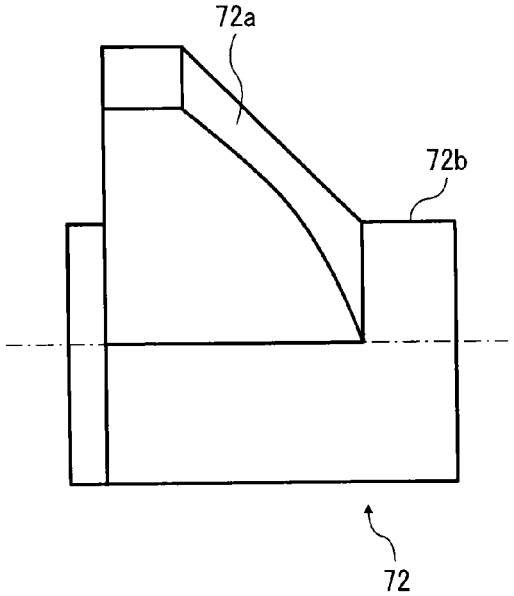
FIG. 7 is a perspective view schematically illustrating a shaft inclining member of the shaft moving device.

Next, with reference to FIG. 7, a description is provided of the shaft inclining member 72.

FIG. 7 is a perspective view schematically illustrating the shaft inclining member 72 according to an illustrative embodiment of the present disclosure.

According to the present illustrative embodiment, the shaft inclining member 72 includes a cylindrical main body, and the outer circumferential surface of the cylindrical main body includes the slanted surface 72*a*. The slanted surface 72*a* is formed of a curved surface that constitutes a part of the circumference of a conical shape, the center of which coincides with the center axis of the cylindrical main body.

There are two reasons for forming the slanted surface 72*a* with a curved surface. The first reason is that even when the shaft inclining member 72 rotates slightly around the rotary shaft 63*a* of the separation roller 63, the angle of inclination of the separation roller 63 does not change. The second reason is that the curved surface of the slanted surface 72*a* allows the slanted surface 72*a* and the contact portion 68*a* of the frame 68 to make a point contact, thereby reducing friction at the contact place. With this configuration, the contact pressure at the end portion of the secondary transfer belt 61 contacting the belt deviation detector 71 is reduced, thereby reducing damage to the end portion of the secondary transfer belt 61 and hence achieving extended belt life expectancy.

According to the present illustrative embodiment, the slanted surface 72*a* is tilted at an inclination angle $\beta$ of approximately 30° relative to the rotary shaft 63*a*. Preferred material of the shaft inclining member 72 includes, but is not limited to, polyacetal (POM).

A bending stress acts repeatedly on the end portion of the outer circumferential surface and of the inner circumferential surface of the secondary transfer belt 61 due to contact with the belt deviation detector 71, thus resulting in damage or breakage of the secondary transfer belt 61. In terms of durability of the secondary transfer belt 61, in some embodiments, a reinforcing tape is adhered around the end portion of the inner and outer circumferential surfaces of the secondary transfer belt 61.

According to the present illustrative embodiment, the outward movement of the shaft inclining member 72 in the axial direction is restricted to a certain range. More specifically, an outer end surface 72*c* (shown in FIG. 4) of the shaft inclining member 72 in the axial direction comes in contact with a second stopper surface 68*c*, thereby preventing the shaft inclining member 72 from moving further outside in the axial direction. In the present illustrative embodiment, the second stopper surface 68*c* of the frame 68 restricts the outward movement of the shaft inclining member 72 in the axial direction. Alternatively, the support arm 64 and the shaft bearing 65 may restrict the outward movement of the shaft inclining member 72 in the axial direction.

Next, a description is provided of an example of the separation roller 63 and the secondary transfer belt 61.

The diameter of the separation roller 63 is approximately ϕ15. The material thereof includes aluminum. The material of the secondary transfer belt 61 includes polyimide. Young's modulus of the secondary transfer belt 61 is approximately 3000 MPa. Folding endurance of the secondary transfer belt 61 measured by the MIT-type folding endurance tester is approximately 6000 times. The thickness of the secondary transfer belt 61 is approximately 80 μm. The linear velocity of the secondary transfer belt 61 is approximately 352 mm/s. The belt tension is approximately 0.9 N/cm.

It is to be noted that the folding endurance measurement by the MIT-type folding endurance tester conforms to the Japanese Industrial Standard (JIS) P8115. More specifically, the measuring conditions of the folding endurance testing are as follows: Testing load: 1 kgf, Flexion angle: 135 degrees, Flexion speed 175 times per minute. A sample belt has a width of 15 mm.

According to the present illustrative embodiment, the intermediate transfer belt 51 that travels while contacting the outer circumferential surface of the secondary transfer belt 61 is also formed into an endless loop. Consequently, it is possible that, similar to the secondary transfer belt 61, the intermediate transfer belt 51 travels out of alignment. Thus, the intermediate transfer belt 51 is provided with a belt alignment device to adjust misalignment of the intermediate transfer belt 51.

The shaft moving device 70 serving as the belt alignment device of the secondary transfer device 60 can be employed as the belt alignment device for the intermediate transfer belt 51. In terms of durability of the intermediate transfer belt 51 using the shaft moving device 70 as the belt alignment device, in some embodiments, a reinforcing tape is adhered around the end portion of the inner and outer circumferential surfaces of the intermediate transfer belt 51. As the reinforcing tape, preferably, a tape made of polyethylene terephthalate (PET) having a width of approximately 6 mm and a thickness of approximately 0.025 mm is used. However, the reinforcing tape is not limited thereto.

In a case in which the secondary transfer belt 61 has the same belt width as the intermediate transfer belt 51 or wider, and both the intermediate transfer belt 51 and the secondary transfer belt 61 travel while the outer circumferential surface of the secondary transfer belt 61 contacts the reinforcing tape adhered to the outer circumferential surface of the intermediate transfer belt 51, the reinforcing tape is adhered in such a manner that the surface of the reinforcing tape with burrs is at the adhesion surface side (the belt surface side). With this configuration, burrs of the reinforcing tape do not interfere with movement of the intermediate transfer belt 51 and the secondary transfer belt 61 in the width direction.

As the belt alignment device for the intermediate transfer belt 51, a guide rib that contacts an end surface of the support roller when the intermediate transfer belt 51 travels out of alignment is formed at both ends of the intermediate transfer belt 51 on the inner circumferential surface side thereof. However, when using the guide rib, a portion of the intermediate transfer belt 51 near the boundary between the guide rib and the inner circumferential surface gets damaged easily due to the bending stress acting on the boundary. For this reason, preferably, a reinforcing tape is adhered around the inner and outer circumferential surfaces of the intermediate transfer belt 51 near the boundary.

As the reinforcing tape, preferably, a tape made of polyethylene terephthalate (PET) having a width of approximately 6 mm and a thickness of approximately 0.025 mm is used. However, the reinforcing tape is not limited thereto. In this case, the reinforcing tape is adhered in such a manner that the surface of the reinforcing tape with burrs is at the adhesion surface side (the belt surface side), as needed.

As the belt alignment device for the intermediate transfer belt 51, a steering-type belt alignment device may be employed. More specifically, in this configuration, an end portion of the intermediate transfer belt 51 in the width direction of the intermediate transfer belt 51 is detected by a detector, and an end of a shaft of one of support rollers (i.e., a steering roller) around which the intermediate transfer belt 51 is looped is moved by a motor, thereby tilting the shaft of the steering roller. Accordingly, the intermediate transfer belt 51 is moved in the width direction in which the intermediate transfer belt 51 is back on track. The belt alignment device of this kind does not correct misalignment of the intermediate transfer belt 51 by contacting the end portion of the intermediate transfer belt 51. Thus, stress on the end portion of the intermediate transfer belt 51 is reduced, hence extending the product life of the belt.

Next, a description is provided of an example of the structure of the intermediate transfer belt 51.

The material of the intermediate transfer belt 51 includes polyimide. Young's modulus of the intermediate transfer belt 51 is approximately 3000 MPa. Folding endurance of the intermediate transfer belt 51 measured by the MIT-type folding endurance tester is approximately 6000 times. The thickness of the intermediate transfer belt 51 is approximately 60 μm. The linear velocity of the intermediate transfer belt 51 is approximately 352 mm/s. The belt tension is approximately 1.3 N/cm.

According to the present illustrative embodiment, the amount of relative positional deviation between the intermediate transfer belt 51 and the secondary transfer belt 61 is at maximum when the intermediate transfer belt 51 and the secondary transfer belt 61 move the greatest distance in the opposite direction from each other in the width direction. Therefore, as compared with a configuration in which only one of the intermediate transfer belt 51 and the secondary transfer belt 61 travels out of alignment, the relative positional deviation is large so that if the reinforcing tape is adhered to one of the outer circumferential surfaces of the intermediate transfer belt 51 and the secondary transfer belt 61 it is important to make sure that the reinforcing tape does not get caught by the other belt without the reinforcing tape due to the difference in height of the belt with the reinforcing tape.

Figure 8:
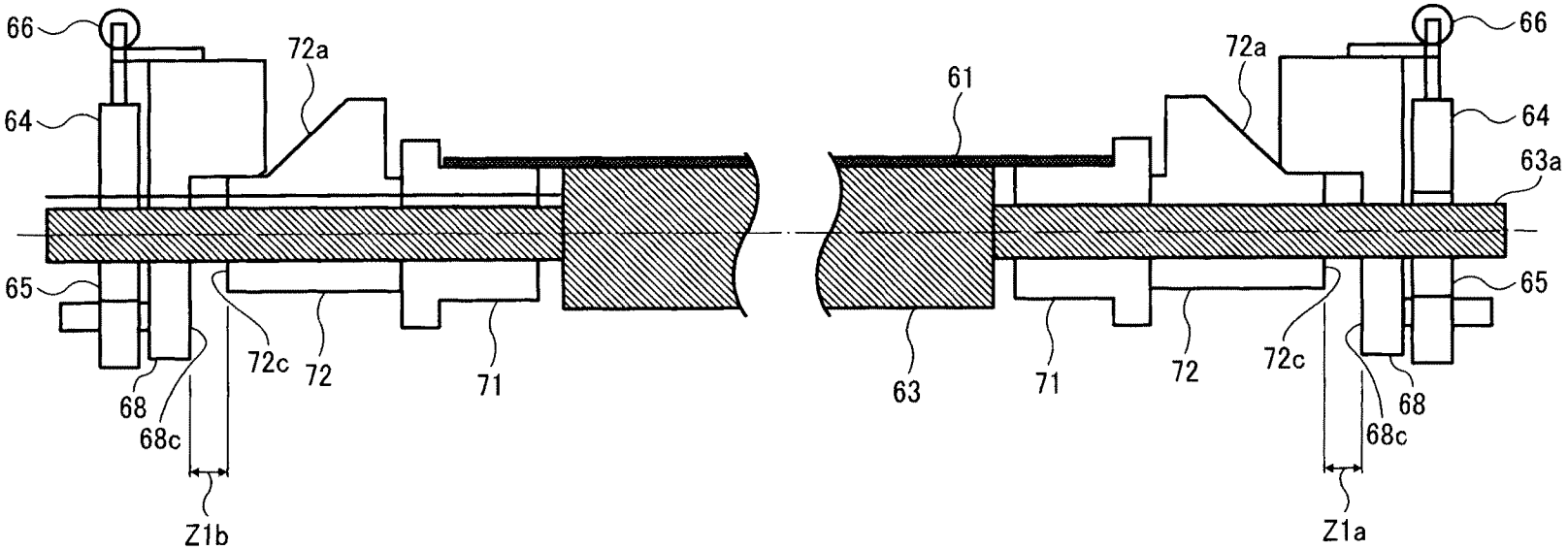
FIG. 8 is a conceptual diagram illustrating the secondary transfer belt at maximum displacement in the width direction of the secondary transfer belt.

As described above, in order to control the displacement amount of the shaft inclining member 72 in the axial direction within a permissible range, the frame 68 includes the second stopper surface 68*c*. As illustrated in FIG. 8, the shaft inclining member 72 disposed at both ends of the secondary transfer belt 61 is movable in a space Z1*a* and in a space Z1*b* between the outer end surface 72*c* of the shaft inclining member 72 in the axial direction and the second stopper surface 68*c* of the frame 68. This configuration allows the separation roller 63 to tilt by an amount corresponding to the amount of displacement of the shaft inclining member 72 in the axial direction. The maximum amount of displacement of the secondary transfer belt 61 in the width direction coincides with a sum of the space Z1*a* and the space Z1*b* between the outer end surface 72*c* of the shaft inclining member 72 in the axial direction and the second stopper surface 68*c* of the frame 68.

Figure 9:
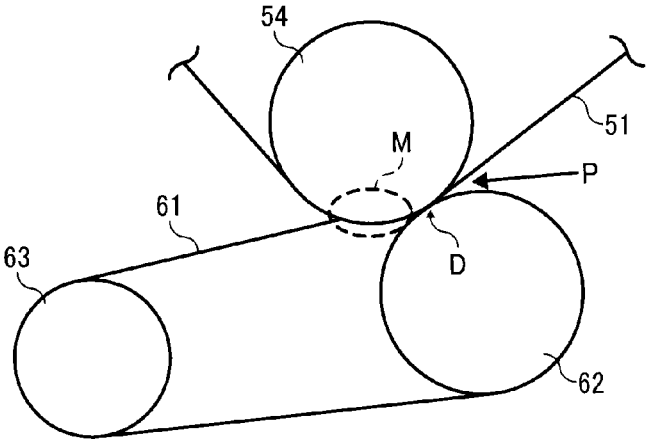
FIG. 9 is a schematic diagram illustrating a configuration around the secondary transfer nip.

Next, with reference to FIG. 9, a description is provided of a configuration around the secondary transfer nip according to the present illustrative embodiment.

FIG. 9 is a schematic diagram illustrating a configuration around the secondary transfer nip. In FIG. 9, a portion of the secondary transfer belt 61 pressed against the intermediate transfer belt 51 by the secondary transfer roller 62 is referred to as a secondary transfer nip D. A portion of the secondary transfer belt 61 adjoining the secondary transfer nip D of the secondary transfer belt 61 at the downstream side in the traveling direction of the secondary transfer belt 61 and contacting the intermediate transfer belt 51 is referred to as a contact portion M.

As the secondary transfer belt 61 contacts the belt deviation detector 71, the secondary transfer belt 61 may crease. However, tension is applied to the contact portion M of the secondary transfer belt 61 by the intermediate transfer belt 51, thereby keeping the contact portion M stretched. When the contact portion M does not crease, a small space that causes an electrical discharge due to dielectric breakdown is not produced between the outer circumferential surface of the secondary transfer belt 61 and the recording medium P near the secondary transfer nip D. With this configuration, image defects attributed to the electrical discharge caused by dielectric breakdown are prevented.

Figure 10A:
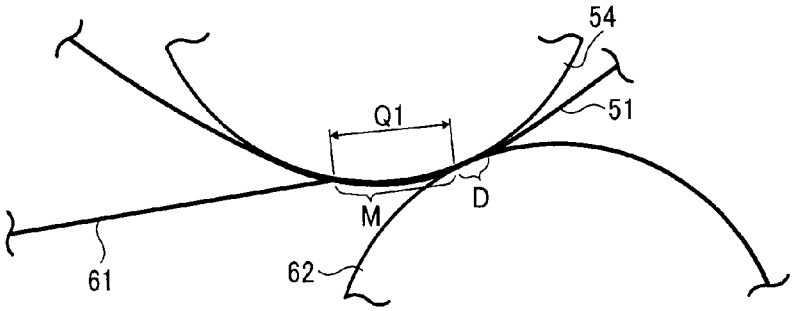
FIGS. 10A and 10B are enlarged schematic diagrams illustrating a configuration around the secondary transfer nip before and after adjustment the secondary transfer belt.
Figure 10B:
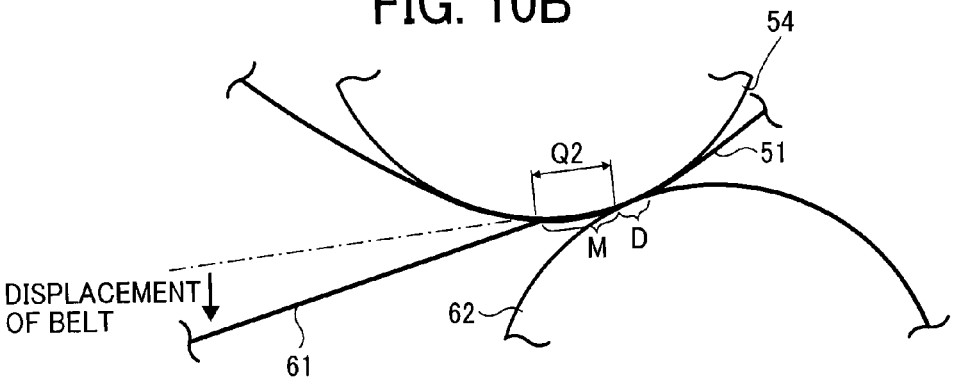

FIGS. 10A and 10B are enlarged diagrams schematically illustrating the configuration around the secondary transfer nip D to explain conditions of the contact portion M when the separation roller 63 is tilted for belt tracking. FIG. 1 OA illustrates a state before adjustment of belt mistracking. FIG. 10B illustrates a state after belt tracking. The width of the contact portion M is changed by tilting the separation roller 63 upon belt tracking.

Assuming that the width of the contact portion M is Q1 before belt tracking as illustrated in FIG. 10A, the width of the contact portion M after belt tracking becomes Q2 as illustrated in FIG. 10B. The width Q2 is shorter than the width Q1 (Q1>Q2) because the separation roller 63 is tilted to move the secondary transfer belt 61 down after belt tracking. In order to prevent image defects even after belt tracking, it is necessary to arrange the repulsive roller 54 such that the width Q2 of the contact portion M is equal to or greater than zero (for example, approximately 1 mm). Preferably, after belt tracking, the width Q2 of the contact portion M is equal to or greater than approximately 2 mm.

[Variation]

Figure 11:
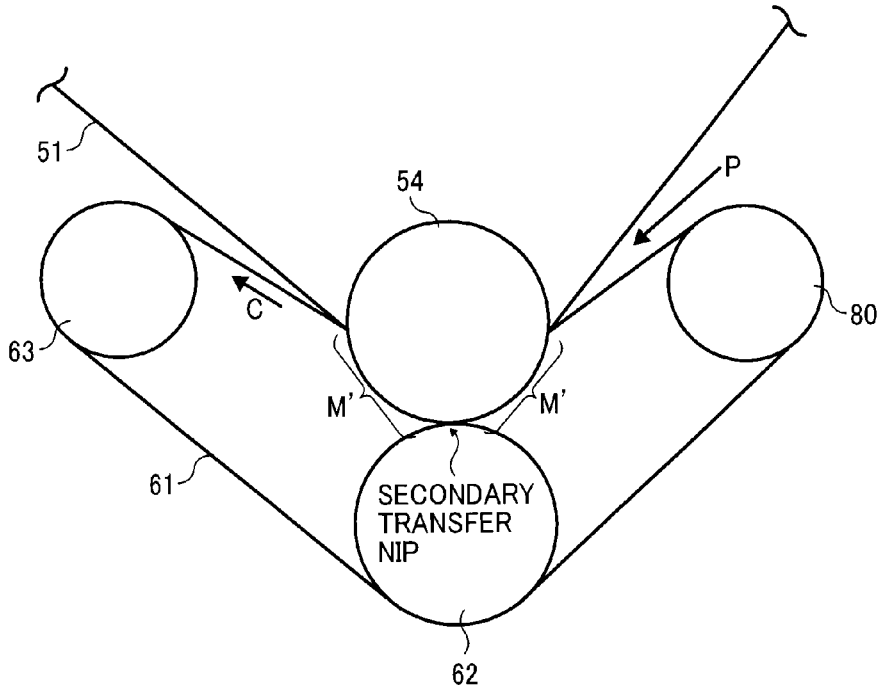
FIG. 11 is a schematic diagram illustrating a variation of the configuration around the secondary transfer nip.

Next, with reference to FIG. 11, a description is provided of a variation of the secondary transfer unit and the configuration around the secondary transfer nip of the present illustrative embodiment.

FIG. 11 is a schematic diagram illustrating the variation of the secondary transfer unit and the configuration around the secondary transfer nip.

According to the variation, the secondary transfer belt 61 is entrained about and stretched taut between the secondary transfer roller 62, the separation roller 63, and an attraction roller 80. One of the support rollers, that is, the secondary transfer roller 62, the separation roller 63, and an attraction roller 80 serves as a drive roller to rotate, thereby enabling the secondary transfer belt 61 to travel in the direction of arrow C in FIG. 11. The recording medium P, onto which the toner image is secondarily transferred, is carried on the outer circumferential surface of the secondary transfer belt 61 and transported while the recording medium P is attracted electrostatically to the outer circumferential surface of the secondary transfer belt 61.

Subsequently, the recording medium P separates from the surface of the secondary transfer belt 61 at the curved portion of the secondary transfer belt 61 entrained about the separation roller 63, and is transported further downstream from the secondary transfer belt 61 in the transport direction of the recording medium P by the conveyor belt 17 disposed downstream from the secondary transfer belt 61. As described with reference to FIGS. 2 through 7, in order to adjust misalignment of the secondary transfer belt 61, the rotary shaft 63*a* of the separation roller 63 is tiltable. In some embodiments, the attraction roller 80 is tiltable.

In FIG. 11, a portion of the secondary transfer belt 61 pressed against the intermediate transfer belt 51 by the secondary transfer roller 62 is referred to as the secondary transfer nip D. Portions of the secondary transfer belt 61 adjoining the secondary transfer nip D of the secondary transfer belt 61 at the upstream side and the downstream side of the secondary transfer belt 61 in the traveling direction of the secondary transfer belt 61 and contacting the intermediate transfer belt 51 are referred to as a contact portion M'. Tension is applied to the contact portion M' of the secondary transfer belt 61 by the intermediate transfer belt 51, thereby keeping the contact portion M' stretched.

Even when the secondary transfer belt 61 contacts the belt deviation detector 71 and hence creases, the contact portion M' does not crease. When the contact portion M' does not crease, a small space that causes an electrical discharge due to dielectric breakdown is not produced between the outer circumferential surface of the secondary transfer belt 61 and the recording medium P near the secondary transfer nip D. With this configuration, image defects attributed to the electrical discharge caused by dielectric breakdown is prevented.

Although the embodiment of the present disclosure has been described above, the present disclosure is not limited to the foregoing embodiments, but a variety of modifications can naturally be made within the scope of the present disclosure.

[Aspect A]

An image forming apparatus includes a rotatable toner image bearer such as the intermediate transfer belt 51 to carry a toner image, a toner image forming device including the photoconductor 1, the charging device 8, the developing device 10, the primary transfer roller 11, and so force to form a toner image on the toner image bearer, a belt such as the secondary transfer belt 61 formed into an endless loop to carry a recording medium P and to travel in a certain direction, a support roller such as the separation roller 63 to rotate the belt, a pressing member such as the secondary transfer roller 62 to press the belt against the toner image bearer, a transfer electric field generator to form an electric field to transfer the toner image from the toner image bearer onto the recording medium, and a contact member such as the belt deviation detector 71 to contact an end surface of the belt as the belt moves to one side in a belt width direction. The belt includes a first portion pressed against the toner image bearer by the pressing member and a second portion adjoining the first portion. A relative position of the support roller relative to the toner image bearer and the pressing member is determined such that the second portion of the belt contacts the toner image bearer.

When the belt contacts the contact member, the belt may crease. The second portion of the belt adjoining the first portion of the belt pressed against the toner image bearer by the pressing member contacts the toner image bearer. Accordingly, the second portion of the belt is tensioned by the toner image bearer and hence is kept stretched. With this configuration, even when the belt contacts the contact member and hence creases, the second portion does not crease. Thus, a small space that causes an electrical discharge due to dielectric breakdown is not produced, thereby preventing image defects attributed to the electrical discharge.

[Aspect B]

According to Aspect A, the support roller serves as the pressing member.

[Aspect C]

According to Aspect A or Aspect B, the support roller includes the contact member.

[Aspect D]

According to any one of Aspects A through C, the image forming apparatus includes a plurality of support rollers, and the plurality of support rollers includes a tiltable support roller, for example, the separation roller 63 with a tiltable rotary shaft.

[Aspect E]

According to Aspect D, irrespective of a degree of inclination of the tiltable support roller, the second portion of the belt adjoining the first portion pressed against the toner image bearer contacts the toner image bearer.

By tilting the tiltable support roller for belt tracking, depending on the degree of inclination of the tiltable support roller, a width of the second portion of the belt adjoining the first portion pressed against the toner image bearer by the pressing member and contacting the toner image bearer changes. Irrespective of a degree of inclination of the tiltable support roller, the second portion contacts the toner image bearer. With this configuration, even when the belt contacts the contact member and hence creases, the second portion does not crease.

[Aspect F]

According to Aspect E, the image forming apparatus further includes an angle controller such as the shaft inclining member 72 that adjusts an inclination angle of the tiltable support roller to prevent the tiltable support roller from tilting beyond a maximum permissible range.

The angle controller controls the inclination angle of the tiltable support roller. With this configuration, the rotary shaft of the tiltable support roller does not tilt beyond the predetermined maximum permissible range, hence allowing reliable belt tracking while minimizing belt wandering.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

a toner image bearer to carry a toner image, the toner image bearer being rotatable;

a toner image forming device to form a toner image on the toner image bearer;

a belt formed into an endless loop to carry a recording medium and to travel in a certain direction;

a support roller to rotate the belt;

a pressing member to press the belt against the toner image bearer;

a transfer electric field generator to form an electric field to transfer the toner image from the toner image bearer onto the recording medium;

a contact member to contact an end surface of the belt as the belt moves to one side in a belt width direction;

a plurality of support rollers, at least one of the plurality of support rollers includes a tiltable support roller with a tiltable rotary shaft;

a support arm that supports the tiltable rotary shaft, the support arm including a shaft bearing that bears the tiltable rotary shaft and is slidable in a radial direction from a center of rotation of the support arm;

an angle adjuster including a slanted surface;

a fixation member configured to contact the slanted surface, wherein movement of the fixation member along a length of the slanted surface adjusts an inclination angle of the tiltable support roller so as not to exceed a maximum permissible angle; and an arm spring having a first end connected to the support arm and a second end connected to the fixation member, wherein the belt including a first portion pressed against the toner image bearer by the pressing member and a second portion adjoining the first portion, wherein a relative position of the support roller relative to the toner image bearer and the pressing member being determined such that the second portion of the belt contacts the toner image bearer, wherein the shaft bearing is biased by a tension spring in the radial direction, and wherein the support arm is attached to a rotary shaft of the pressing member such that the center of rotation of the support arm is about the pressing member and the radial direction along which the shaft bearing slides extends through the pressing member.

2. The image forming apparatus according to claim 1, wherein the support roller serves as the pressing member.

3. The image forming apparatus according to claim 1, wherein the support roller includes the contact member.

4. The image forming apparatus according to claim 1, wherein the second portion of the belt contacts the toner image bearer irrespective of a degree of inclination of the tiltable support roller.

5. The image forming apparatus according to claim 1, wherein the slanted surface is tilted at an inclination angle of 30° relative to the tiltable rotary shaft.

6. The image forming apparatus according to claim 1, wherein the slanted surface is a curved surface having a conical shape.

* * * * *